US007322909B1

(12) United States Patent
Loccarini et al.

(10) Patent No.: US 7,322,909 B1
(45) Date of Patent: Jan. 29, 2008

(54) DOORWAY-MOUNTED EXERCISE DEVICE WITH RESISTANCE BANDS

(76) Inventors: Darin A. Loccarini, 5804 Bayshore Blvd., Tampa, FL (US) 33611; Matthew B. Lytell, 5804 Bayshore Blvd., Tampa, FL (US) 33611

( * ) Notice: Subject to any disclaimer, the term of this patent is extended or adjusted under 35 U.S.C. 154(b) by 133 days.

(21) Appl. No.: 11/308,352

(22) Filed: Mar. 17, 2006

(51) Int. Cl.
*A63B 21/04* (2006.01)
*A63B 21/02* (2006.01)

(52) U.S. Cl. ..... 482/129; 482/126; 482/904

(58) Field of Classification Search ..... 482/38–40, 482/121, 122, 126, 128, 129, 904
See application file for complete search history.

(56) References Cited

U.S. PATENT DOCUMENTS 2,919,134 A * 12/1959 Zuro ..... 482/129
5,176,602 A * 1/1993 Roberts ..... 482/131
5,186,696 A * 2/1993 Pfefferle et al. ..... 482/40
6,652,419 B1 * 11/2003 Rota ..... 482/27
7,066,866 B1 * 6/2006 Mobley ..... 482/40
D526,367 S * 8/2006 Loccarini et al. ..... D21/662

* cited by examiner

*Primary Examiner*—Fenn C. Mathew
*Assistant Examiner*—Allana Lewin
(74) *Attorney, Agent, or Firm*—Ronald E. Smith; Smith & Hopen P.A.

(57) ABSTRACT

A portable exercise device includes a main tube having an adjustable length. The main tube includes a central tube and an outboard tube connected to opposite ends of the central tube. First and second door jamb gripping devices adapted to engage a door stop of a door jamb are secured to respective outermost ends of the outboard tubes. A handle is secured to each outboard tube and a pulley is mounted within a hollow interior of each outboard tube. A first resistance band has a first end engaged to a third handle, a second end engaged to a fourth handle, and a medial part positioned in a hollow interior of the main tube that engages the first and second pulleys.

9 Claims, 2 Drawing Sheets

DOORWAY-MOUNTED EXERCISE DEVICE WITH RESISTANCE BANDS

FIELD OF THE INVENTION

This invention relates, generally, to portable exercise devices. More particularly, it relates to an exercise device that can be mounted at any height in a doorway and which includes resistance bands so that it may be used in scores of exercises.

DESCRIPTION OF THE PRIOR ART

Resistance bands generally require a user to stand on the bands during the exercise period. The number of exercises that can be performed while standing on resistance bands is limited.

There is a need, therefore, for a resistance band-reliant exercise device that does not require a user to stand on it.

Some devices require a user to clamp one end of a resistance device to a door or door knob and to exercise by pulling on the other end. This positions the resistance bands in a "V"-shaped configuration and makes the exercises somewhat unbalanced or unstable. Modern fitness club machines and weights, on the other hand, provide resistances that are in line with the trajectory of the opposing force.

There is therefore a need for a portable resistance band-reliant exercise device that provides such in-line resistances, just like modern exercise machines and weights.

Still other devices require one end of a resistance band to be attached to a wall or some other immovable object. This limits the number of exercises that can be performed. The number is reduced even further if the bands must be secured to a wall or other immovable object at a particular height or to a doorway at a particular elevation.

Thus there is a need for a resistance band exercise device that can be mounted at any elevation in a doorway.

Another drawback is that the known resistance bands exercise devices present only one level of resistance. Thus, as the exerciser becomes more conditioned, exercising with the same bands provides less and less benefit.

Thus there is a need for an exercise device that enables a user to easily adjust the amount of resistance provided by the device.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a means for a resistance band exercise device that enables the performance of a large plurality of exercises is now met by a new, useful, and non-obvious invention. The novel portable exercise device includes a main tube having an adjustable length. The main tube includes a central tube, a first outboard tube connected to a first end of the central tube and a second outboard tube connected to a second end of the central tube. The central tube screwthreadedly engages the first outboard tube and the second outboard tube so that rotation of the central tube in a first direction causes the first and second outboard tubes to travel away from one another, thereby increasing an overall length of the main tube and so that rotation of the central tube in a second direction opposite to the first direction causes the first and second outboard tubes to travel toward one another, thereby decreasing the overall length of the main tube. A first handle is rotatably secured to the first outboard tube and a second handle is rotatably secured to the second outboard tube.

A first door jamb gripping device is secured to an outermost end of the first outboard tube and a second door jamb gripping device is secured to an outermost end of the second outboard tube. Each door jamb gripping device is adapted to engage a door jamb and door stop at any preselected height along an extent thereof. Each door jamb gripping device includes a centrally apertured flat plate and a pair of parallel flanges disposed in transverse relation to one another. The flanges of each door jamb gripping device are spaced from one another by a space sufficient to receive a common door jamb and door stop between them.

A first pulley is rotatably mounted in a hollow interior of the first outboard tube and a second pulley is rotatably mounted in a hollow interior of the second outboard tube.

Third and fourth handles are unconnected to the main tube. A first elongate resistance band has a first end engaged to the third handle, a second end engaged to the fourth handle, and a medial part positioned in a hollow interior of the main tube that engages the first and second pulleys. Accordingly, exercises may be performed when an exerciser is gripping the first and second handles or the third and fourth handles.

Each of the pulleys has a plurality of troughs and each trough of the plurality of troughs is adapted to engage a resistance band. An exerciser may therefore employ a plurality of resistance bands when performing an exercise.

Each of the handles has a "D" shape, including a straight-in-configuration hand grip and an arcuate-in-configuration hand shield. Each resistance band is releasably secured at its opposite ends to the respective hand shields of the third and fourth handles. Each of the third and fourth handles includes a reinforcing brace connected to their respective hand shields in concentric, spaced apart relation thereto.

A loop is formed in each end of each resistance band and each of the loops is disposed in encircling relation to an associated hand shield and reinforcing brace of the hand shields.

The central drive tube has opposite ends that are internally threaded in opposite directions. The first outboard slip tube has external screwthreads formed therein that are in screwthreaded engagement with the internal threads formed in the first end of the central tube so that rotation of the central tube in a first direction effects outward travel of the first outboard slip tube and so that rotation of the central tube in a second direction opposite to the first direction effects inward travel of the first outboard tube. The second outboard tube also has external screwthreads formed therein that screwthreadedly engage the internal threads formed in the second end of the central tube so that rotation of the central tube in a first direction effects outward travel of the second outboard tube and so that rotation of the central tube in a second direction opposite to the first direction effects inward travel of the second outboard tube.

A grip member is disposed in ensleeving relation to the central tube and is positioned substantially mid-length of the central tube. The grip member is secured to the central tube so that rotation of the grip member about its longitudinal axis of symmetry effects simultaneous and corresponding rotation of the central drive tube.

A primary advantage of the novel exercising device is its portability. Being small and light-in-weight enables a user to take it on business trips, vacations, and the like so that an exercise schedule is not interrupted by such trips.

Another important advantage is the large number of beneficial exercises that may be performed with the device.

Still another advantage is its versatility in offering a plurality of resistance bands so that a user may exercise with different resistances by combining the resistance bands in differing combinations.

Yet another advantage is that the first and second handles, being directly connected to the main bar, enable exercises that do not include resistance bands.

Another advantage is the speed with which the device may be mounted within a doorway by rotating the grip provided on the central bar in a first direction and the speed with which it may be removed from the doorway by rotating the grip in a second, opposite direction.

The handles may also be exchanged for leg or other attachments, thereby providing additional exercises.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
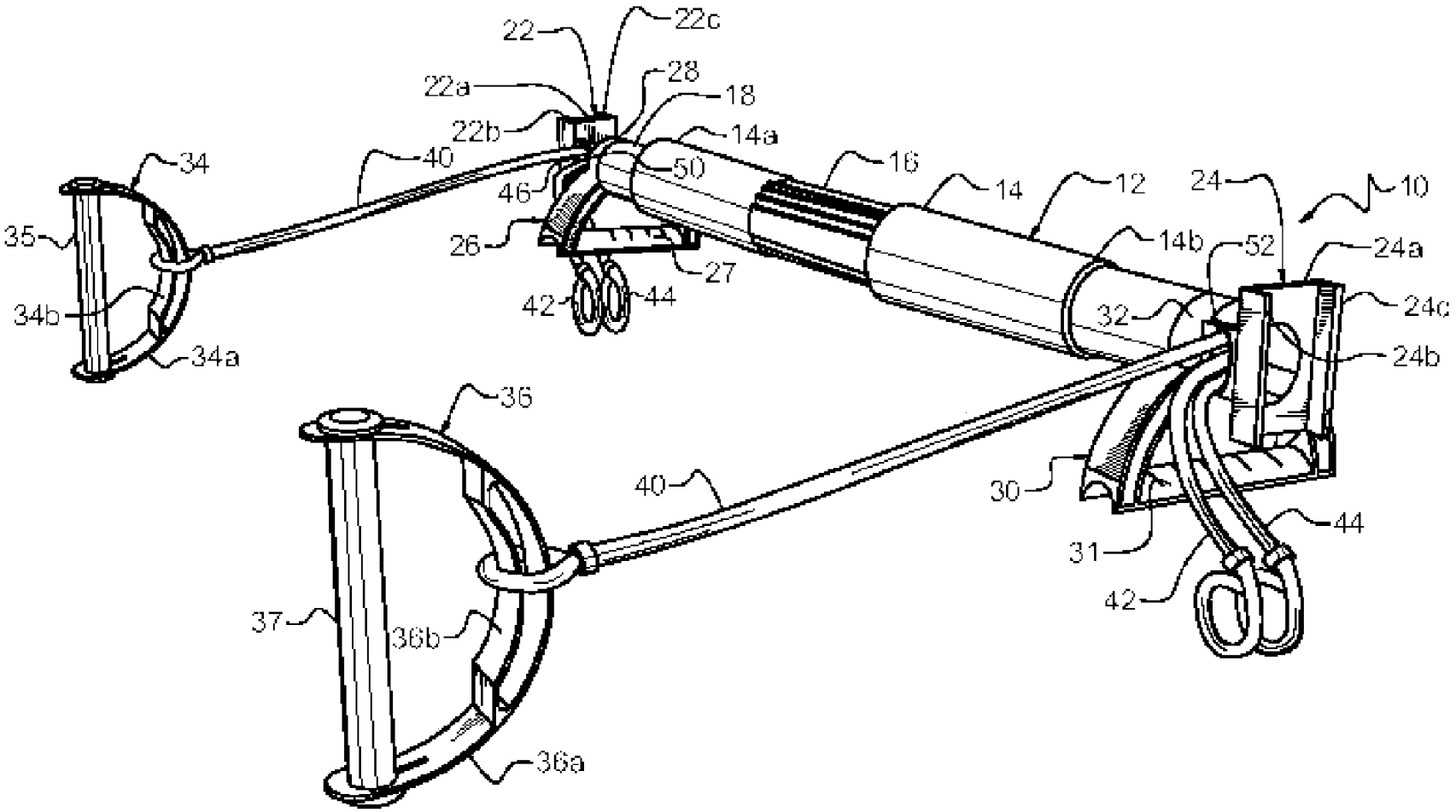
FIG. 1 is a perspective view of the novel exercise device.
Figure 2A:
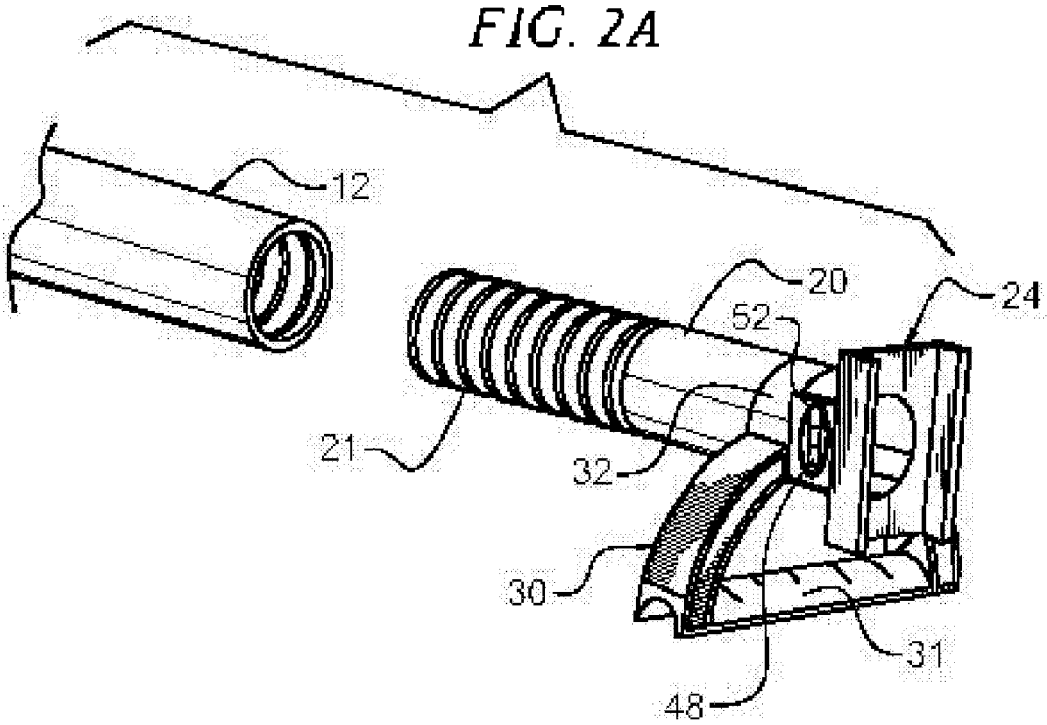
FIG. 2A is an exploded perspective view of an outboard tube and the parts connected thereto.

Referring now to FIGS. 1 and 2A, it will there be seen that an illustrative embodiment of the invention is denoted as a whole by the reference numeral 10.

Adjustable tube 12 has three (3) primary parts. Central tube 14 is hollow and has opposite ends 14*a* and 14*b* that are internally threaded in opposite directions. Thus, left end 14*a* may have left-hand internal threads formed therein and right end 14*b* may have right-hand internal threads formed therein, or vice versa.

Grip member 16 ensleeves central tube 14 and is located mid-length thereof. Grip member 16 is secured to central part 14 so that rotation of grip member 16 about its longitudinal axis of symmetry effects simultaneous and corresponding, i.e., conjoint rotation of central tube 14.

The two (2) remaining primary parts of adjustable tube 12 are externally threaded left or first outboard tube 18 and externally threaded right or second outboard tube 20. Only the respective inboard ends of outboard tubes 18 and 20 are externally threaded. FIG. 2A depicts external threads 21 formed in outboard tube 20.

The respective external diameters of outboard tubes 18 and 20 are less than the internal diameter of central tube 14. Outboard tubes 18 and 20 are thus received within the hollow interior of central tube 14 when the respective internally threaded outboard ends of central tube 14 screwthreadedly engage the respective inboard externally threaded ends of outboard tubes 18 and 20.

A first door jamb gripping device 22 is secured to the outermost end of outboard tube 18 and a second door jamb gripping device 24 is secured to the outermost end of outboard tube 20. Each door jamb gripping device includes a centrally apertured flat plate 22*a*, 24*a* and a pair of parallel flanges, denoted 22*b*, 22*c*, and 24*b*, 24*c* disposed in transverse relation to one another. The distance between the flanges of each door jamb gripping device is sufficient to receive the door stop of a door jamb.

To mount novel device 10 to a doorway, each door jamb gripping device 22, 24 is placed into alignment with a door jamb at any preselected height along the extent thereof. Both door jamb gripping devices 22, 24 must be substantially level with one another. Center grip 16 and hence central tube 14 are then rotated in a predetermined direction and such rotation causes outboard tubes 18 and 20 and hence door jamb gripping devices 22, 24 to diverge away from one another along a common longitudinal axis of symmetry. Such rotation is continued until the door jamb gripping devices 22, 24 are in firm, unslippable contact with their respective door jambs. A rubber coating protects the door jamb paint and further enhances the non-slip aspect of the structure. Installation requires no drilling, tools, or mounting hardware.

The assembly just described is not to be used as a pull-up bar. Unlike a pull-up bar, novel portable exercise device 10 is positionable at differing heights in a doorway for differing exercises. It is a simple matter to rotate central tube 14 in a direction opposite to its tightening direction to enable adjustment of its height. For some exercises, it may be positioned just a few inches from a floor and used to hold down the feet of a user.

A first handle 26 is rotatably secured to left outboard tube 18. Handle 26 has a general "D" shape and includes a straight handgrip 27 which may include cushioning material. The arcuate, hand-shielding part of the "D" shape is discontinuous near its center to accommodate circular clamp 28 that encircles outboard tube 18. Circular clamp 28 and the arcuate parts of the "D" shaped hand shield are integrally formed with one another. First handle 26 is therefore rotatable in either direction about outboard tube 18 without restriction to prevent interference with the resistance bands.

Second handle 30 is rotatably secured to right outboard tube 20. Handle 30 also has a general "D" shape and includes a straight hand grip 31 which may include cushioning material. The arcuate, hand-shielding part of the "D" shape is discontinuous near its center to accommodate circular clamp 32 that encircles outboard tube 20. Circular clamp 32 and the arcuate parts of the "D" shaped hand shield are integrally formed with one another. Second handle 30 is therefore rotatable in either direction about outboard tube 20 without restriction to prevent interference with the resistance bands.

First and second handles 26 and 30 are rotatable about their respective outboard tubes 18, 20 independently of each other although most exercises will require that the user hold both handles in a common orientation.

Handles 26 and 30 have utility in numerous exercises that may be performed with the novel apparatus.

Third and fourth handles 34 and 36 have a "D"-shape as well and include straight-in-configuration hand grips 35, 37 respectively. Unlike first and second handles 26, 30, the respective arcuate parts 34*a* and 36*a* of handles 35, 37 are continuous in structure.

In a preferred embodiment, each handle 34, 36 includes a reinforcing plate 34*b*, 36*b* connected to arcuate parts 34*a*, 36*a*, respectively, in concentric, spaced apart relation thereto. The ends of each handle are adapted to be opened to enable changing the configuration of the resistance bands.

Three (3) resistance bands 40, 42, and 44 are employed in the preferred embodiment. As depicted in FIG. 1, the opposite ends of resistance band 40 are respectively formed into loops and connected to the arcuate parts of handles 34, 36, in encircling relation to parts 34*a*, 34*b* and 36*a*, 36*b*. The opposite ends of resistance bands 42 and 44 are also formed into loops and may be placed into engagement with handles 34, 36 in the same way at the option of the user. Resistance band 40 might have a resistance of five (5) pounds, for example, whereas resistance band 42 might have a resistance of ten (10) pounds and resistance band 44 might have a resistance of twenty (20 pounds). This enables a user to use all three (3) resistance bands to obtain a resistance of thirty five (35) pounds, or to use different combinations of resistance bands to obtain various lesser resistances. Resistance bands having different resistances than those recited here are of course within the scope of this invention. Moreover, a user may vary the amount of resistance by adjusting his or her proximity to the device.

Each resistance band wraps around a pulley having a vertical axis of rotation as drawn. Pulley 46 is rotatably mounted about a vertical axis of rotation within the hollow interior of outboard tube 18 and pulley 48 is rotatably mounted about a vertical axis of rotation within the hollow interior of outboard tube 20. As used herein, the axis of rotation is vertical when portable exercise device 10 is properly installed in a doorway. The wrap angle expressed in radians for each pulley is about 1.57 radians (ninety degrees divided by 57.3° per radian). As best understood in connection with FIG. 2A, each pulley has three troughs, one for each resistance band.

Figure 2B:
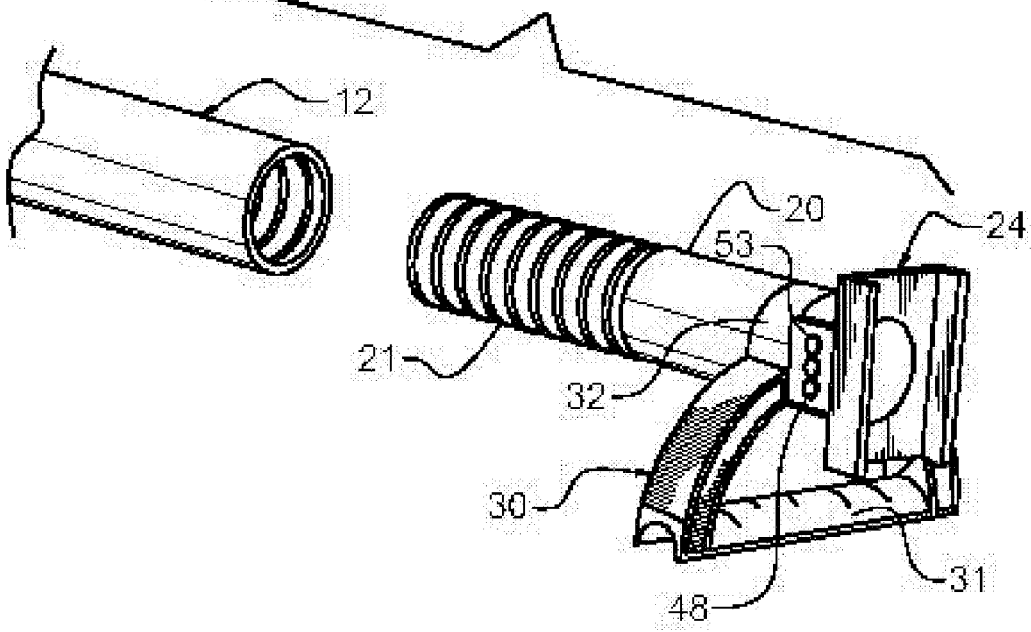
FIG. 2B is an exploded perspective view of a slightly different embodiment of said outboard tube and the parts connected thereto.

An oblong nylon border 50, 52 frames the forward-facing outlet of pulleys 46, 48, respectively. In an alternative embodiment, each border is changed to a three-holed outlet, denoted 53 in FIG. 2B, so that each aperture serves as a band guide for each resistance band, keeping each resistance band in its assigned pulley groove. As used herein, "forward" is the side of device 10 from which the exercise bands extend. Each nylon border 50, 52 is formed in a mounting block 54, 56, respectively, that is mounted to its associated door jamb gripping device 22, 24.

A large number of exercises may be performed with device 10. Some exercises are formed in a standing position facing the device and some are performed in a standing position facing away therefrom or standing side-ways with respect thereto. Still further exercises are performed while sitting on a floor facing the device, away from the device, or side-ways with respect thereto. Additional exercises may be performed while lying in a supine or prone position.

Being small and light-in-weight, it can be carried and used at any travel destination so that a work-out schedule can be followed even when the user is away from home on extended trips.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A portable exercise device, comprising: a main tube having an adjustable length; said main tube including a central tube, a first outboard tube connected to a first end of the central tube and a second outboard tube connected to a second end of the central tube; said central tube screwthreadedly engaging said first outboard tube and said second outboard tube so that rotation of said central tube in a first direction causes said first and second outboard tubes to travel away from one another, thereby increasing an overall length of said main tube and so that rotation of said central tube in a second direction opposite to said first direction causes said first and second outboard tubes to travel toward one another, thereby decreasing the overall length of said main tube;

a first door jamb gripping device secured to an outermost end of said first outboard tube; a second door jamb gripping device secured to an outermost end of said second outboard tube; each door jamb gripping device being adapted to engage a door stop of a door jamb at any preselected height along an extent thereof; a first handle rotatably secured to said first outboard tube; a second handle rotatably secured to said second outboard tube; a first pulley rotatably mounted in a hollow interior of said first outboard tube; a second pulley rotatably mounted in a hollow interior of said second outboard tube; a third handle unconnected to said main tube; a fourth handle unconnected to said main tube; a first elongate resistance band having a first end engaged to said third handle, a second end engaged to said fourth handle, and a medial part positioned in a hollow interior of said main tube that engages said first and second pulleys; whereby exercises may be performed when an exerciser is gripping said first and second handles or said third and fourth handles.

2. The portable exercise device of claim 1, further comprising: each of said pulleys having a plurality of troughs; each trough of said plurality of troughs adapted to engage a resistance band; whereby an exerciser may employ a plurality of resistance bands when performing an exercise.

3. The portable exercise device of claim 2, further comprising: each of said handles having a "D" shape, including a straight-in-configuration hand grip and an arcuate-in-configuration hand shield; each resistance band being releasably secured at its opposite ends to the respective hand shields of said third and fourth handles.

4. The portable exercise device of claim 3, further comprising: each of said third and fourth handles including a reinforcing brace connected to their respective arcuate-in-configuration hand shields in concentric, spaced apart relation thereto.

5. The portable exercise device of claim 4, further comprising: a loop formed in each end of each resistance band; each of said loops being disposed in encircling relation to an associated hand shield and reinforcing brace of said hand shields.

6. The portable exercise device of claim 1, further comprising: said central tube having opposite ends that are internally threaded in opposite directions; said first outboard tube having external screwthreads formed therein and said first outboard tube being in screwthreaded engagement with said internal threads formed in said first end of said central tube so that rotation of said central tube in a first direction effects outward travel of said first outboard tube and so that rotation of said central tube in a second direction opposite to said first direction effects inward travel of said first outboard tube; said second outboard tube having external screwthreads formed therein and said second outboard tube being in screwthreaded engagement with said internal threads formed in said second end of said central tube so that rotation of said central tube in a first direction effects outward travel of said second outboard tube and so that rotation of said central tube in a second direction opposite to said first direction effects inward travel of said second outboard tube.

7. The portable exercise device of claim 1, further comprising: a grip member disposed in ensleeving relation to said central tube; said grip member being positioned substantially mid-length of said central tube and said grip member being secured to said central tube so that rotation of said grip member about its longitudinal axis of symmetry effects simultaneous and corresponding rotation of said central tube.

8. The portable exercise device of claim 1, further comprising: each of said door jamb gripping devices including a centrally apertured flat plate and a pair of parallel flanges disposed in transverse relation to one another, said flanges of each door jamb gripping device being spaced from one another by a space sufficient to receive a door stop of a door jamb between them.

9. The portable exercise device of claim 1, further comprising: said first and second handles having a "D" shape; said first and second handles including a straight hand grip; a first circular clamp disposed in encircling relation to said first outboard tube;

a second circular clamp disposed in encircling relation to said second outboard tube; said first and second handles including an arcuate, hand-shielding part that is discontinuous near its center to accommodate said first and second circular clamps, respectively; said first and second circular clamps and said arcuate-in-configuration parts of said hand shields being integrally formed with one another; whereby said first and second handles are independently rotatable in either direction about said first outboard tube and said second outboard tube without restriction.

* * * * *